United States Patent [19]

Powell

[11] Patent Number: 4,827,859

[45] Date of Patent: May 9, 1989

[54] BOAT

[76] Inventor: Gary R. Powell, P.O. Box 361, Quitaque, Tex. 79255

[21] Appl. No.: 221,725

[22] Filed: Jul. 20, 1988

[51] Int. Cl.[4] ..... B63B 1/22

[52] U.S. Cl. ..... 114/61; 114/357

[58] Field of Search ..... 114/61, 355, 357, 292, 114/283, 65 R, 267; 441/35, 44

[56] References Cited

U.S. PATENT DOCUMENTS

| | | | |
|---|---|---|---|
| 4,303,033 | 12/1981 | King | 114/61 |
| 4,517,911 | 5/1985 | Seefeld | 114/61 |
| 4,537,144 | 8/1985 | Horton | 114/61 |

*Primary Examiner*—Joseph F. Peters, Jr.
*Assistant Examiner*—Edwin L. Swinehart
*Attorney, Agent, or Firm*—Wendell Coffee

[57] ABSTRACT

A fishing boat has two pontoons connected by a panel. The boat is made of expanded copolymer, preferably a mixture of polystyrene and polyethylene. The bottom of the panel is above the water line when the boat is carrying a normal load. A motor mount is clamped to the stern of the boat by bolting a metal plate above and below a pad at the rear of the panel. A tie rod connects the front of the pontoons. Bores or buckets in the top of the pontoons are closed by a plastic cover over a plastic rim adhered into the top of the bores or buckets.

18 Claims, 2 Drawing Sheets

BOAT

RIGHTS TO INVENTIONS UNDER FEDERAL RESEARCH

There was no federally sponsored research and development concerning this invention.

BACKGROUND OF THE INVENTION (1) Field of the Invention

This invention relates to boats, and more particularly to a one man, one piece expanded copolymer styrofoam fishing boat.

(2) Description of the Related Art

There have been many attempts to provide a suitable fishing boat of this type.

BAUMAN ET AL, U.S. Pat. No. 1,503,624 discloses a folding float with a sheet upon which a user is in a horizontal or crawl position.

DYSARD ET AL, U.S. Pat. No. 3,067,441 discloses a boat or float of expanded polystyrene having an opening or corridor or well between two walls or pontoons. He also provides a deck area and a seating place.

MATHEW, U.S. Pat. No. 3,117,327 shows a floating chair much the same configuration as DYSARD except his seat has been replaced by a metal frame seat and back with open webbing. It is made of unicellular buoyant material and intended primarily for swimmers.

ECHOLS, U.S. Pat. No. 4,315,475 provides two pontoons having a connecting framework. A chair is mounted upon the connecting framework so that the occupant can sit. A motor can be mounted on the framework for propulsion. The occupant of the chair can rest his feet on the framework out of the water. The pontoons are lightweight sheet metal.

CHANDLER is similar to ECHOLS in that he, too, makes provisions for a motor and a seat where the feet can be placed above the water and has two pontoons made of foamed material surrounded with skin. Above the pontoons are trusses which have depressions or pan shaped cavities therein. ARCO Chemical Company, a division of Atlantic-Richfield Refining Company, 1500 Market Street, Philadelphia, Pa. 19101, produces Arcel, which is a mixture of polystyrene and polyethylene. Arcel is provided in bead form, which may be placed in a cavity and expanded to fill the cavity and adhere together to form a structurally sound product, all as is well known to the resin or polymer art.

SUMMARY OF THE INVENTION (1) Progressive Contribution to the Art

This invention seeks to provide a satisfactory solution to a boat which can be either foot propelled or propelled by a motor. It is made of one single piece of expanded copolymer material. The preferred material is Arcel, as discussed above. There are provisions for placing fishing poles, minnow buckets, live bate, and other equipment upon the boat.

There are two distinct pontoons, and a connecting panel is above the water line with one person aboard. The panel is made particularly lightweight, yet retaining its strength by having the lower portion thereof with reduction in volume by having ribs extending within what is otherwise a cavity. The material that is removed for the different buckets on the pontoon decks and the cavity on the bottom reduces the material needed to construct the boat. A bar across the pontoon bows serves to reenforce the two pontoons where they are not connected by the panel.

A motor mount is located at the stern so that a motor may be mounted on the boat to propel it in a forward direction. The boat may be propelled by the occupant kicking, moving in the opposite direction from motor propulsion.

(2) Objects of this Invention

An object of this invention is to provide a fishing boat.

Further objects are to achieve the above with a device that is sturdy, compact, durable, lightweight, simple, safe, efficient, versatile, ecologically compatible, energy conserving, and reliable, yet inexpensive and easy to manufacture, operate and maintain.

The specific nature of the invention, as well as other objects, uses and advantages thereof, will clearly appear from the following description and from the accompanying drawing, the different views of which are not scale drawings.

Figure 1:
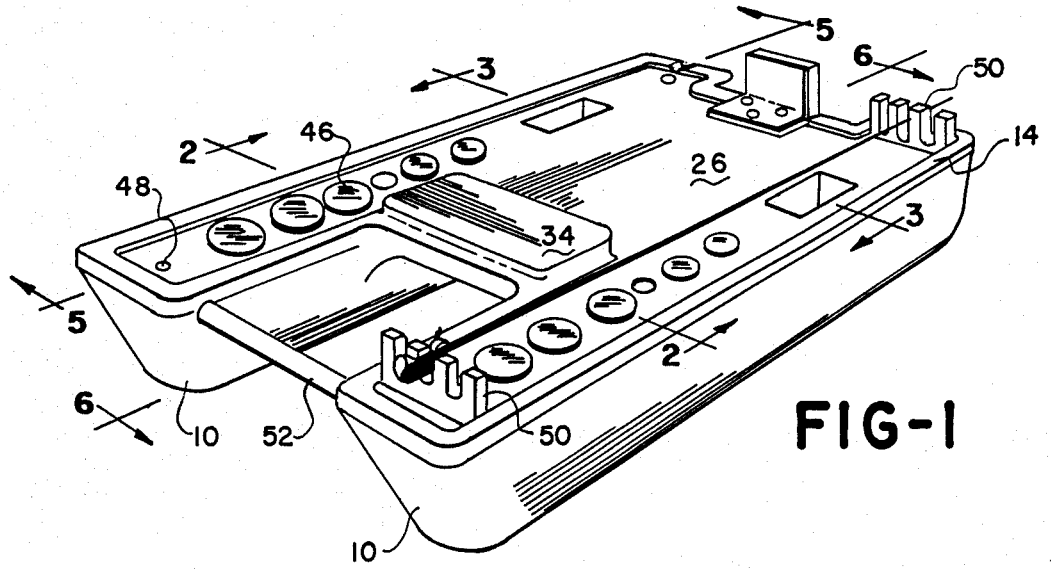
FIG. 1 is a perspective view of the boat with motor mount and fishing gear aboard.

As an aid to correlating the terms of the claims to the exemplary drawing, the following catalog of elements and steps is provided:

10 pontoons
12 panel
14 splash rail
16 pontoon deck
18 pontoon bow
20 pontoon stern
22 notches
24 transom
26 panel deck
28 forward edge
30 pontoon bottom
32 panel bottom
34 seat
36 pockets
38 grids
40 buckets
42 bins
44 rim
46 lid
48 pole holder
50 rack
52 tie rod
53 end of rod 54 pad
56 angled metal plate
58 flat bottom plate
60 anchor bolts
62 wooden transom
64 transom bolts
B bow angle
S stern angle

DESCRIPTION OF THE PREFERRED EMBODIMENT

Referring particularly to the drawing, there may be seen, the boat. The boat basically has two pontoons 10 connected by panel 12.

Each pontoon has an overall length. Each pontoon has a height from the top to bottom 30. The top of the pontoon is considered to be the top of splash rail 14 which projects upward from pontoon deck 16. Bow 18 has bow angle B to vertical of about 30°. Stern 20 has stern angle S to vertical of about 20°. As may be seen, the bow is on one end and the stern 20 is on the other end of each pontoon 10. There are at least two notches 22 in the splash rail 14 so any water upon the deck 16 may drain therefrom. These are shown at the stern of each pontoon.

Panel 12 includes transom 24 near the pontoon sterns 20. Deck 26 of the panel is flush (i.e., the same height) as deck 16 of the pontoons. The transom 24 is a distance from stern 20 equal to about 1/12 of the overall length of the pontoons. Forward edge 28 of panel 12 has a splash rail even with splash rail 14 of the pontoons. The edge 28 is approximately ⅓ of the length of the pontoons from the bow 18 of the pontoons. Panel 12 has a thickness of approximately ⅓ of the height of the pontoons.

The boat is particularly designed to carry one fisherman and the equipment, i.e., a total of about 200 pounds. The volume of the pontoons is such that about ⅓ of the pontoons will displace about 235 pounds of water, i.e., when normally loaded, the water level on the pontoons will be about ⅓ of the height from the bottom 30 of the pontoons 10. It may be seen, therefore, that the bottom of the panel will be about ⅓ of the height of the pontoons from the water in normal operation.

With the panel bottom 32 clear of the water, there is less drag to motion of the boat. Therefore, an extremely small horsepower motor mounted on the boat will propel the boat. Also a man equipped with flippers on his feet can readily propel the boat. The forward portion of the upper surface of the panel is raised for seat 34 for the fisherman to sit when using the boat.

Figure 8:
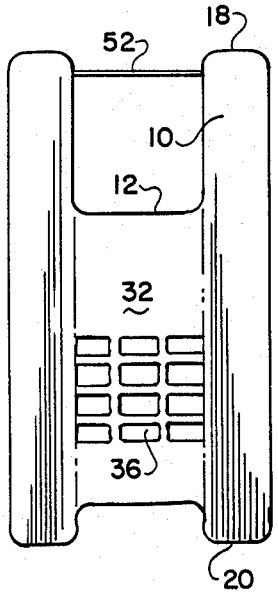
FIG. 8 is a bottom plan view of the boat.
Figure 3:
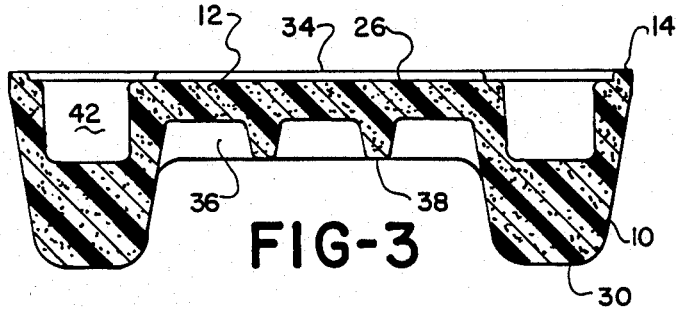
FIG. 3 is a cross sectional view taken substantially on line 3—3 of FIG. 1.

The bottom 32 of the panel beneath the deck portion 26 has a cavity. This cavity is divided into a plurality of smaller cavities or pockets 36 by grids 38, as may be seen from FIGS. 3, 6, and 8. Since the bottom 32 of the panel normally is above the water line, this irregular surface of the bottom does not add any impedance or drag to the propulsion of the boat. Also, in case of rough weather, it does not decrease the buoyancy of the boat inasmuch as with the boat right side up, the cavities 36 will always be filled with air so that they will float the boat. Therefore, this portion of the boat has not been filled with the expanded polymer material, but with the grids, the strength is retained and the buoyancy maintained.

Figure 2:
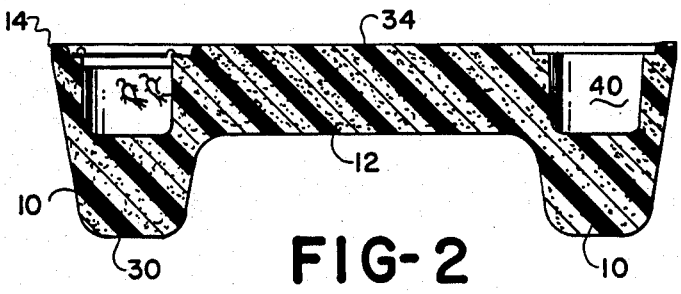
FIG. 2 is a cross sectional view taken substantially on line 2—2 of FIG. 1.
Figure 7:
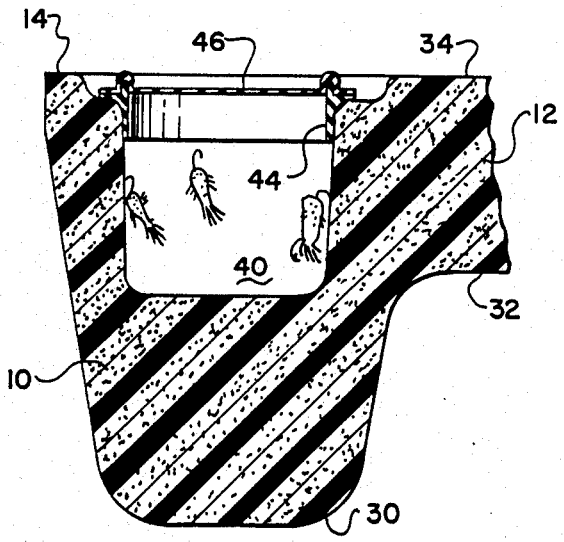
FIG. 7 is a detailed cross sectional view taken as an enlarged section of that shown in FIG. 2, showing details of the storage bins, and taken substantially on line 7—7 of FIG. 9.
Figure 9:
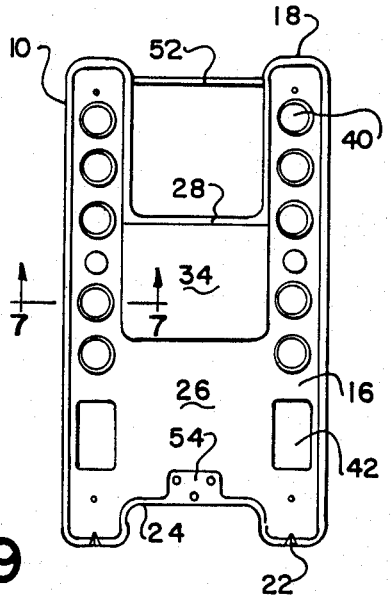
FIG. 9 is a top plan view of the boat.

Many bins, holes, or storage compartments are made in the deck 16 of the pontoons 10. The buckets 40 are cylindrical shaped bores while the bins 42 are rectangular in plan. The buckets or bores 40 have a depth of more than about ⅓ the height of the pontoons and less than about ½ the height of the pontoons. The buckets 40 have a diameter greater than their depth. As seen in FIG. 7, plastic ring or rim 44 is fit in the top of each of the larger buckets. They are adhered in place. Plastic lid or cover 46 is placed over the top of each of the rims, thereby closing the buckets so that water will not splash therein. The buckets provide a convenient storage space for different fishing equipment. e.g., FIGS. 2 and 7 show lures attached to the walls of the buckets. It will be understood that although the expanded polymer material of the boat is sufficiently rugged to receive a certain amount of rough treatment, that it still is subject to puncture by the fishing hooks so that they can be conveniently hung from the interior walls of the buckets 40. For illustration purposes, some of the buckets have been shown without the plastic rings and covers. Obviously the storage compartments provided by the buckets 40 and bins 42 could be used for any purpose that is desired.

A smaller diameter pole holder 48 is provided near the bow and stern of each pontoon. It also can be used for any convenient purpose, e.g., FIG. 1 shows a rack attached to each pole holder. The rack 50 has a convenient bolt or pin depending from the bottom thereof into the pole holder 48. Racks 50 provide a holder for fishing rods which may extend from one to the other.

Figure 4:
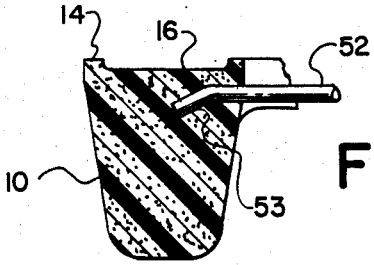
FIG. 4 is a cross sectional view taken on a line parallel to FIGS. 2 and 3 at the bar across the bow of the boat.
Figure 5:
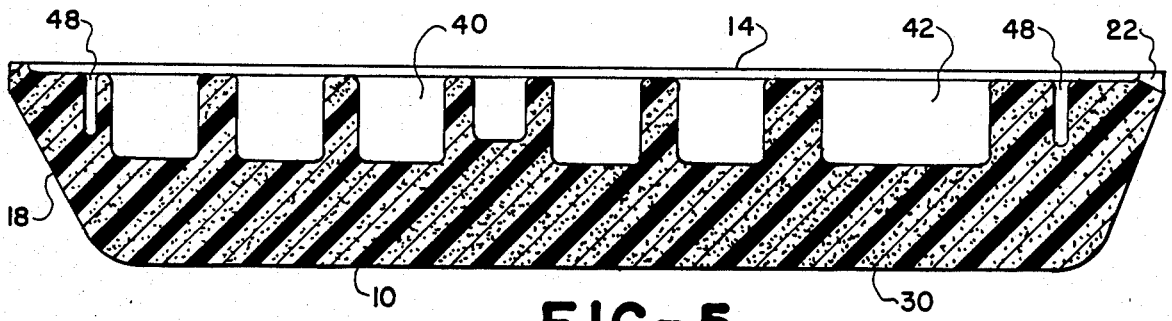
FIG. 5 is a longitudinal sectional view through one pontoon taken substantially on line 5—5 of FIG. 1.

To provide additional strength for the boat, strut or tie rod 52 extends from one pontoon to the other at the bow of the boat. The end 53 of the strut is bent at an angle, as seen in FIG. 4, so that it is more securely anchored within the expanded polymer material. As may be seen, the pontoons and panel of the boat are a single piece of expanded copolymer material symmetrical about the center line between the pontoons.

The deck 26 is that portion of the panel between the seat 34 and pad 54.

Figure 6:
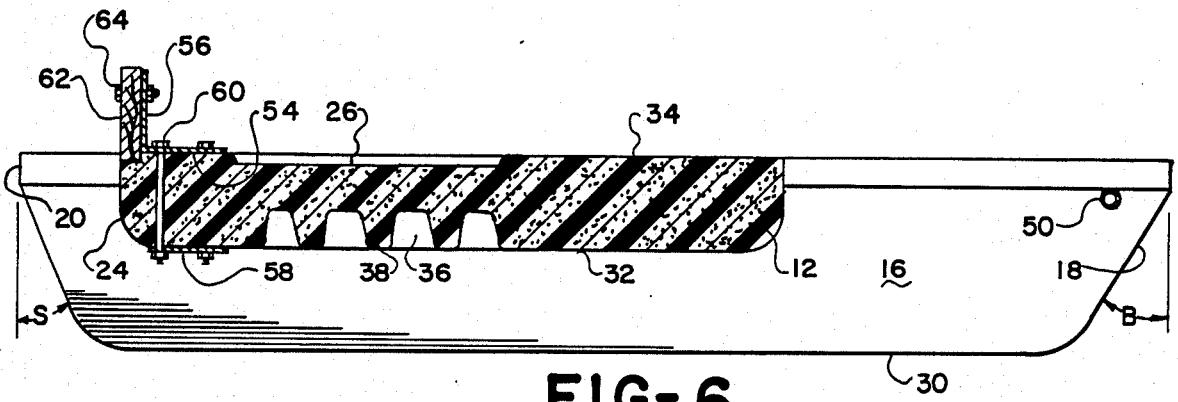
FIG. 6 is a longitudinal sectional view taken substantially on line 6—6 of FIG. 1, which is the center line of the boat.

The pad 54 is located at the transom 24 of the panel 12. Angled metal plate 56 has one portion which fits flat against the pad 54 (FIG. 6). The other portion of the angled plate 56 extends vertically upward. Flat bottom plate 58 is attached to the bottom 32 of the panel 12. Three anchor bolts 60 extend through bolt holes which are through the angled plate 56, bottom plate 58, and pad 54. The anchor bolts through the anchor holes clamp the pad 54 of the panel between the bottom plate 58 and the angled plate 56. The top of the pad is the same height as the top of the seat 34 and the top of the splash rail 14. Vertical wooden transom 62 is securely connected to the vertical portion of the angled plate 56 by transom bolts 64. Therefore, it may be seen a small outboard motor may be attached to the wooden transom 62 as is well known in the aquatic arts.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A boat comprising:

two parallel pontoons, each having i. an overall length,
ii. a height from bottom to top,
iii. a bow at one end,
iv. a stern at the other end, and
v. a pontoon deck on the top, a panel connecting the two pontoons, having
i. a transom near the pontoon sterns,
ii. a panel deck flush with the pontoon deck,
iii. a seat raised above the panel deck, and
iv. a bottom, said panel extending
i. from about ⅓ the pontoon length from the bow to about 1/12 of the pontoon length from the stern, and
ii. less than about ½ the pontoon height, the pontoons and panel of the boat is a single piece of expanded copolymer symmetrical about a center line between the pontoons, and a tie rod between the bows of the pontoons.

2. The invention as defined in claim 1 wherein:
said copolymer is a mixture of polystyrene and polyethylene.

3. The invention as defined in claim 1 wherein:
said tie rod is bent on each end for anchoring into the expanded copolymer of the pontoons.

4. The invention as defined in claim 1 wherein:
said panel between the raised seat and transom on the bottom thereof has a series of grids forming a series of pockets so that a reduced amount of copolymer material is used.

5. The invention as defined in claim 1 further comprising:
a plurality of compartments in the pontoon deck of each pontoon,
said compartments extending more than ⅓ of the height of the pontoon and less than ½ the height of the pontoon.

6. The invention as defined in claim 5 further comprising:
some of the compartments being buckets having diameters more than their depth.

7. The invention as defined in claim 6 further comprising:
a plastic ring at the top of a plurality of said buckets,
said plastic ring adhered to the expanded copolymer base around the bucket, and
a removable plastic cover on each of the rings, thereby making it weatherproof.

8. The invention as defined in claim 5 wherein:
two of said compartments being rectangular bins and having a width equal to the depth and a length greater than the depth,
one of said bins near the stern of each pontoon.

9. The invention as defined in claim 1 further comprising:
a mounting pad raised above the panel deck at the transom thereof,
a metal angle plate on the raised pad,
a flat bottom plate below the raised pad of the panel,
anchor bolt holes through the angle plate, bottom plate, and the pad,
anchor bolts through the anchor holes clamping the pad of the panel between the bottom plate and the angle plate,
a vertical wooden transom extending upward from said panel,
transom bolts securely bolting the wooden transom to the angle plate,
whereby a motor mount is provided for an outboard motor.

10. The invention as defined in claim 1 further comprising:
said panel having a thickness of about ⅓ of the height of the pontoons, and
said pontoons having a volume so that the bottom ⅓ of the pontoons displays sufficient water to float the boat together with an adult man and equipment,
whereby the distance from the bottom of the panel to the water is about ⅓ the height of the pontoons.

11. The invention as defined in claim 10 further comprising:
a mounting pad raised above the panel deck at the transom thereof,
a metal angle plate on the raised pad,
a flat bottom plate below the raised pad of the panel,
anchor bolt holes through the angle plate, bottom plate, and the pad,
anchor bolts through the anchor holes clamping the pad of the panel between the bottom plate and the angle plate,
a vertical wooden transom extending upward from said panel,
transom bolts securely bolting the wooden transom to the angle plate,
whereby a motor mount is provided for an outboard motor.

12. The invention as defined in claim 11 wherein:
said copolymer is a mixture of polystyrene and polyethylene.

13. The invention as defined in claim 12 wherein:
said tie rod is bent on each end for anchoring into the expanded copolymer of the pontoons.

14. The invention as defined in claim 13 wherein:
said panel between the raised seat and transom on the bottom thereof has a series of grids forming a series of pockets so that a reduced amount of copolymer material is used.

15. The invention as defined in claim 14 further comprising:
a plurality of compartments in the pontoon deck of each pontoon,
said compartments extending more than ⅓ of the height of the pontoon and less than ½ the height of the pontoon.

16. The invention as defined in claim 15 further comprising:
some of the compartments being buckets having diameters more than their depth.

17. The invention as defined in claim 16 further comprising:
a plastic ring at the top of a plurality of said buckets,
said plastic ring adhered to the expanded copolymer base around the bucket, and
a removable plastic cover on each of the rings, thereby making it weatherproof.

18. A boat comprising:
two parallel pontoons, each having
i. an overall length,
ii. a height from bottom to top,
iii. a bow at one end,
iv. a stern at the other end, and
v. a pontoon deck on the top, a panel connecting the two pontoons, having
i. a transom near the pontoon sterns,
ii. a panel deck flush with the pontoon deck, iii. a seat raised above the panel deck, and
iv. a bottom, said panel extending
i. from about $\frac{1}{3}$ the pontoon length from the bow to about 1/12 of the pontoon length of the stern, and
ii. less than about $\frac{1}{2}$ the pontoon height, the pontoons and panel of the boat is a single piece of expanded copolymer symmetrical about a center line between the pontoons, a tie rod between the bows of the pontoons, said copolymer is a mixture of polystyrene and polyethylene, said tie rod is bent on each end for anchoring into the expanded copolymer of the pontoons, a mounting pad raised above the panel deck at the transom thereof, a metal angle plate on the raised pad, a flat bottom plate below the raised pad of the panel, anchor bolt holes through the angle plate, bottom plate, and the pad, anchor bolts through the anchor holes clamping the pad of the panel between the bottom plate and the angle plate, a vertical wooden transom extending upward from said panel, transom bolts securely bolting the wooden transom to the angle plate, whereby a motor mount is provided for an outboard motor, said panel between the raised seat and transom on the bottom thereof has a series of grids forming a series of pockets so that a reduced amount of copolymer material is used, said panel having a thickness of about $\frac{1}{3}$ of the height of the pontoons, said pontoons having a volume so that the bottom $\frac{1}{3}$ of the pontoons displaces sufficient water to float the boat together with an adult man and equipment, whereby the distance from the bottom of the panel to the water is about $\frac{1}{3}$ the height of the pontoons, a plurality of compartments in the pontoon deck of each pontoon, said compartments extending more than $\frac{1}{3}$ of the height of the pontoon and less than $\frac{1}{2}$ the height of the pontoon, some of the compartments being buckets having diameters more than their depth, a plastic ring at the top of a plurality of said buckets, said plastic ring adhered to the expanded copolymer base around the bucket, a removable plastic cover on each of the rings, thereby making it weatherproof, two of said compartments being rectangular bins and having a width equal to the depth and a length greater than the depth, and one of said bins near the stern of each pontoon.

* * * * *